US007477213B2

(12) United States Patent
Yim et al.

(10) Patent No.: US 7,477,213 B2
(45) Date of Patent: Jan. 13, 2009

(54) PLASMA DISPLAY DEVICE AND DRIVING METHOD OF PLASMA DISPLAY PANEL

(75) Inventors: Sang-Hoon Yim, Suwon-si (KR); Takahisa Mizuta, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 607 days.

(21) Appl. No.: 11/055,746

(22) Filed: Feb. 10, 2005

(65) Prior Publication Data

US 2005/0200564 A1 Sep. 15, 2005

(30) Foreign Application Priority Data

Mar. 11, 2004 (KR) ..... 10-2004-0016441
Jun. 29, 2004 (KR) ..... 10-2004-0049324

(51) Int. Cl.
*G09G 3/18* (2006.01)

(52) U.S. Cl. ..... 345/63; 345/66; 315/169.4

(58) Field of Classification Search ..... 345/37, 345/41, 42, 60, 63, 67, 68, 208; 313/582; 315/169.4
See application file for complete search history.

(56) References Cited

U.S. PATENT DOCUMENTS 4,859,910 A 8/1989 Iwakawa et al.
4,866,349 A 9/1989 Weber et al.
5,081,400 A 1/1992 Weber et al.
5,541,618 A * 7/1996 Shinoda ..... 345/60
6,356,017 B1 3/2002 Makino
6,819,055 B2 * 11/2004 Tessier ..... 315/169.1
7,215,303 B2 5/2007 Ando et al.
2001/0015621 A1 * 8/2001 Oniki ..... 313/582
2003/0038757 A1 2/2003 Kojima
2003/0201953 A1 * 10/2003 Shiizaki et al. ..... 345/63

FOREIGN PATENT DOCUMENTS

CN 1242857 A 1/2000
CN 1325124 A 12/2001
CN 1434975 A 8/2003

(Continued)

OTHER PUBLICATIONS

European Search Report, dated Jun. 22, 2005, for application No. 05100559.3, in the name of Samsung SDI Co., Ltd.

(Continued)

*Primary Examiner*—Amr Awad
*Assistant Examiner*—Jeff Pelligrino
(74) *Attorney, Agent, or Firm*—Christie, Parker & Hale, LLP

(57) ABSTRACT

A plasma display device, which is capable of improving a discharge efficiency of a plasma display panel by increasing a partial pressure of Xe. When the partial pressure of Xe is increased, a proportion of (Xe—Xe)* dimer emitting a 147 resonance line is higher than that of Xe* monomer emitting a 173 nm molecular beam. Particularly, when the partial pressure of Xe is above 10%, the discharge efficiency is improved by setting a frequency of a sustain discharge pulse applied to scan electrodes and sustain electrodes alternately during sustain period above 300 kHz.

7 Claims, 7 Drawing Sheets

FOREIGN PATENT DOCUMENTS

| | | | | |
|---|---|---|---|---|
| CN | 1542717 | A | 11/2004 | |
| EP | 0 752 696 | A2 | 1/1997 | |
| EP | 0 790 597 | A1 | 8/1997 | |
| EP | 1 475 770 | A2 | 11/2004 | |
| FR | 0102043 | A2 * | 8/2002 | ..... 315/169.1 |
| JP | 6-318053 | | 11/1994 | |
| JP | 11-109914 | | 4/1999 | |
| JP | 11-202830 | | 7/1999 | |
| JP | 2002-123214 | | 4/2002 | |
| JP | 2003-43987 | | 2/2003 | |
| KR | 2002-0062656 | | 7/2002 | |

OTHER PUBLICATIONS

Patent Abstracts of Japan, Publication No. 06-318053, dated Nov. 15, 1994, in the name of Shiyuuji Nakamura.

Patent Abstracts of Japan, Publication No. 11-109914, dated Apr. 23, 1999, in the name of Takashi Hashimoto.

Patent Abstracts of Japan, Publication No. 11-202830, dated Jul. 30, 1999, in the name of Mitsuyoshi Makino.

Patent Abstracts of Japan, Publication No. 2002-123214, dated Apr. 26, 2002, in the name of Hiroshi Okada.

Patent Abstracts of Japan, Publication No. 2003-043987, dated Feb. 14, 2003, in the name of Hiroyuki Tachibana.

* cited by examiner

PLASMA DISPLAY DEVICE AND DRIVING METHOD OF PLASMA DISPLAY PANEL

CROSS REFERENCE TO RELATED APPLICATION

This application claims priority to and the benefit of Korean Patent Applications No. 10-2004-0016441 filed on Mar. 11, 2004 and No. 10-2004-0049324 filed on Jun. 29, 2004, in the Korean Intellectual Property Office, the contents of which are incorporated herein by reference.

BACKGROUND OF THE INVENTION (a) Field of the Invention

The present invention relates to a plasma display device and a method for driving a plasma display panel (PDP), and more particularly, to a frequency of a sustain discharge pulse applied to the PDP.

(b) Description of the Related Art

Plasma display devices are displays that use a PDP for displaying characters or images using plasma generated by gas discharge. The PDP includes, according to its size, more than several tens to millions of pixels (discharge cells) arranged in the form of a matrix.

FIG. 1 is a perspective view illustrating part of a general PDP. Scan electrodes 4 and sustain electrodes 5 covered with a dielectric layer 2 and a protective layer 3 are arranged in pairs in parallel on a first glass substrate 1. A plurality of address electrodes 8 covered with an insulation layer 7 are arranged on a second glass substrate 6. Barrier ribs 9 are formed in parallel with the address electrodes 8 on the insulation layer 7 such that each barrier rib 9 is interposed between the adjacent address electrodes 8. A phosphor 10 is coated on the surface of the insulation layer 7 and on both sides of each partition wall 9. The first and second glass substrates 1 and 6 are arranged to face each other while defining a discharge space 11 therebetween so that the address electrodes 8 are orthogonal to the scan electrodes 4 and sustain electrodes 5. In the discharge space, a discharge cell 12 is formed at an intersection between each address electrode 8 and each pair of the scan electrodes 4 and sustain electrodes 5.

In general, a process for driving the AC PDP can be expressed by temporal operational periods, i.e., a reset period, an address period and a sustain period. The reset period is a period wherein the state of each cell is intialized such that an addressing operation of each cell is smoothly performed. The address period is a period wherein an address voltage is applied to an addressed cell to accumulate wall charges on the addressed cell in order to select a cell to be turned on and a cell not to be turned on in the PDP. During the sustain period, a sustain discharge pulse is alternately applied to the scan electrode 4 and the sustain electrode 5 in pairs. A difference in voltage between the scan electrode 4 and the sustain electrode 5 alternates between sustain discharge voltages Vs and −Vs. In this case, when a wall voltage is applied between the scan electrode Y and the sustain electrode X by address discharge during the address period, sustain discharge is created in the scan electrode Y and the sustain electrode X by the wall voltage and the sustain discharge voltage Vs.

Discharge efficiency is changed by the frequency of the sustain discharge pulse during the sustain period. A known technique related to the frequency of the sustain discharge pulse is disclosed in U.S. Pat. No. 6,356,017 issued to Makino where it is suggested that the discharge efficiency can be improved by having the frequency f of the sustain discharge pulse satisfy the relationship of the following Equation 1:

$$f \geq \frac{\mu_i Vs}{\pi d^2}$$

where, $\mu_i$ is ion mobility, Vs is a sustain voltage, d is a gap between the scan electrode and the sustain electrode.

Recently, also for the purpose of improving the discharge efficiency, a partial pressure of xenon (Xe) gas injected as a discharge gas into the discharge space has been increased over 10%. In general, when the partial pressure of Xe is low, Xe* monomer emits light. When the partial pressure of Xe is increased over 10%, (Xe—Xe)* dimer emits light. The Xe* monomer emits a 147 nm resonance line. Ultraviolet rays are absorbed in the 147 nm resonance line before this line is absorbed into Xe and arrives at a phosphor. In addition, when Xe* is struck by electrons, it is changed to Xe. As such, the ultraviolet ray can not be converted to a visible ray, which results in energy loss.

(Xe—Xe)* dimer emits a 173 nm molecular beam. This beam arrives at the phosphor directly without being absorbed by Xe or (Xe—Xe), which leads to a good energy efficiency. In addition, since the (Xe—Xe)* dimer delivers energy to the phosphor rapidly, the risk of it being struck by electrons is greatly reduced. Accordingly, the frequency range suggested by Makino is not proper when (Xe—Xe)* dimer is used to improve the energy efficiency. In addition, because the frequency suggested by Makino is very high, the sustain discharge pulse must use a sinusoidal wave instead of a square wave.

SUMMARY OF THE INVENTION

In accordance with the present invention a frequency of a sustain discharge pulse, is provided which is capable of improving a discharge efficiency when a partial pressure of Xe is high in a plasma display panel.

In accordance with the present invention a plasma display device is provided having a plasma display panel and a driver. The plasma display panel has discharge cells formed by at least two electrodes including a first electrode and a second electrode, and the driver applies a sustain discharge pulse to at least one of the first electrode and the second electrode during a sustain period such that a voltage difference between the first electrode and the second electrode alternates between a positive voltage and a negative voltage.

In an exemplary embodiment, a partial pressure of Xe of discharge gases injected into discharge spaces of the discharge cells is above 10%.

In an exemplary embodiment, the frequency of the sustain discharge pulse is over 300 kHz.

In an exemplary embodiment, the frequency of the sustain discharge pulse is below 2.5 MHz.

In an exemplary embodiment, the frequency of the sustain discharge pulse is below 1 MHz.

In an exemplary embodiment, the sustain discharge pulse has a frequency f $$f \geq \left\{\left(\frac{D\mu_i Vs}{\pi d^2}\right)^{-1} + k(Tr + Tf) + 2s\right\}^{-1}$$

defined by where, $D\mu_i$ is mobility of Xe ions of the discharge gases injected into the discharge spaces of the discharge cells, Vs (V) is the absolute value of the positive voltage or the negative voltage, d[cm] is a gap between the first electrode and the second electrode, Tr(s) and Tf(s) are rising time and falling time of the sustain discharge pulse, respectively, k is a period of time determined by the rising time and the falling time of a period of time when an absolute value of the voltage difference between the first electrode and the second electrode is not Vs during one cycle of the sustain discharge pulse, s is a period of time except a period of time corresponding to the rising time and the falling time and a period of time when an absolute value of the voltage difference between the first electrode and the second electrode is Vs during one cycle of the sustain discharge pulse.

In an exemplary embodiment, the sustain discharge pulse has a frequency f $$f < \frac{\mu_i Vs}{\pi d^2}$$

defined by

In accordance with another aspect of the present invention a method is provided for driving a plasma display panel having discharge cells formed by at least two electrodes. Discharge cells to be turned on are selected from among the discharge cells formed by at least two electrodes, and sustain discharge for the selected discharge cells is created by applying a sustain discharge pulse having a predetermined frequency between 300 kHz and 2.5 MHz to the selected discharge cells.

DETAILED DESCRIPTION

Figure 2:
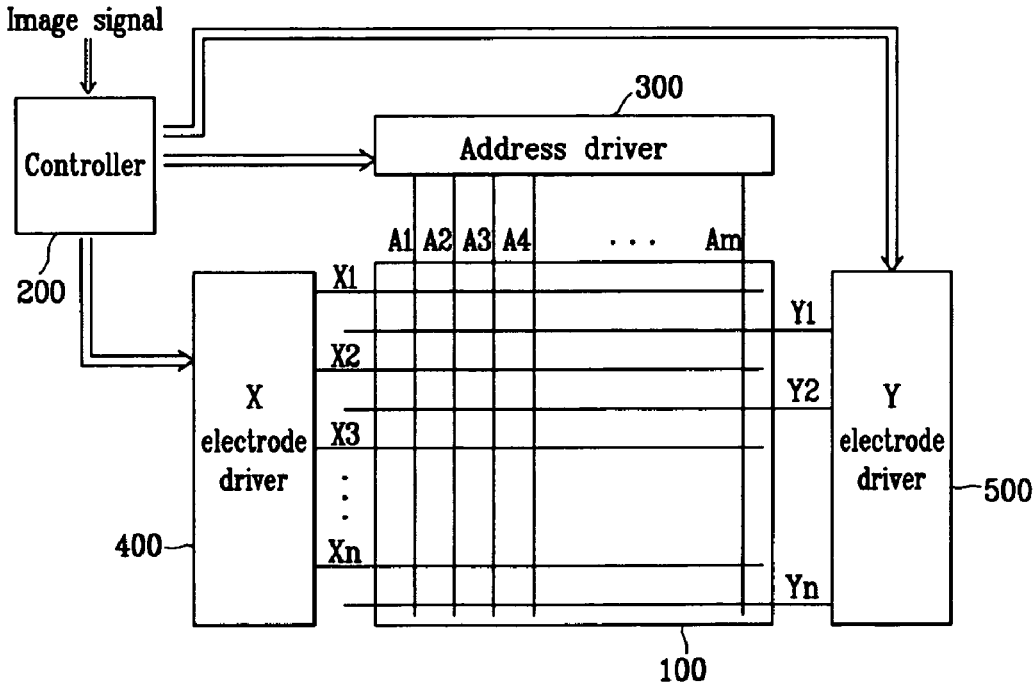
FIG. 2 is a block diagram illustrating a plasma display device according to an embodiment of the present invention.

Referring to FIG. 2, the plasma display device includes a plasma display panel 100, a controller 200, an address electrode driver 300, a sustain electrode driver 400, and a scan electrode driver 500.

Figure 1:
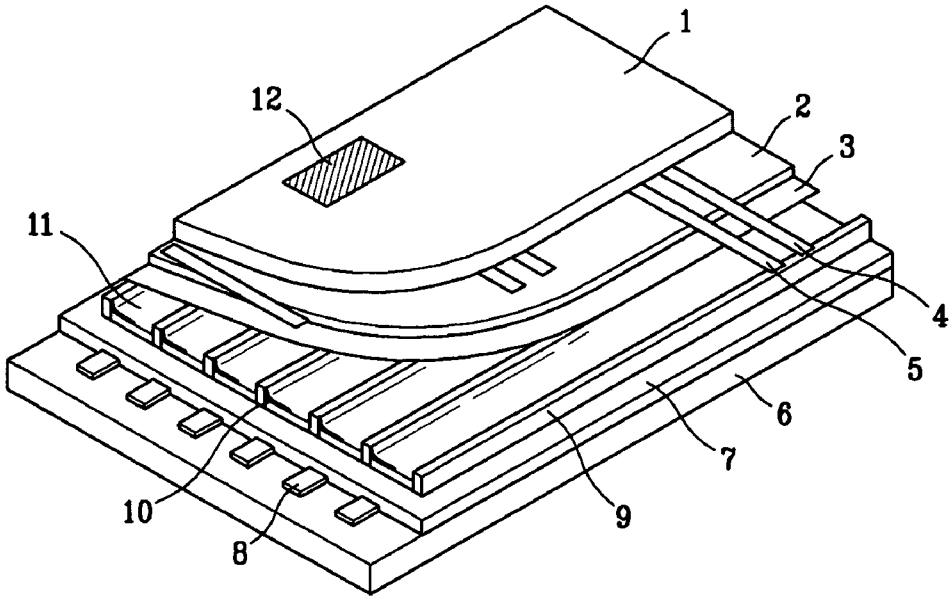
FIG. 1 (Prior Art)
FIG. 1 is a perspective view illustrating part of an AC PDP.

The plasma display panel 100 includes a plurality of address electrodes A1 to Am (referred to as "A" electrodes hereinafter) extending in a column direction, and a plurality of sustain electrodes X1 to Xn (referred to as "X" electrodes hereinafter) and a plurality of scan electrodes Y1 to Yn (referred to as "Y" electrodes hereinafter) alternately extending in pairs in a row direction. The X electrodes X1 to Xn are formed corresponding to respective Y electrodes Y1 to Yn, and their ends are coupled in common. The plasma display panel 100 includes a substrate (not shown) on which the X and Y electrodes X1 to Xn and Y1 to Yn are arranged, and a substrate (not shown) on which the A electrodes A1 to Am are arranged. The two substrates face each other with a discharge space therebetween so that the Y electrodes Y1 to Yn may cross the A electrodes A1 to Am and the X electrodes X1 to Xn may cross the A electrodes A1 to Am. In this instance, discharge spaces on the crossing points of the A electrodes A1 to Am and the X and Y electrodes X1 to Xn and Y1 to Yn form discharge cells, similar to those described with regard to FIG. 1. Each of Y electrodes and each of X electrodes may have corresponding projection electrodes (not shown), which project toward an adjacent Y electrode and an adjacent X electrode, respectively, and face each other. A gap (d) between a Y electrode, for example, an electrode Y1, and an X electrode paired with the Y electrode, for example, an electrode X1, is a shortest distance between a Y electrode and an X electrode paired with the Y electrode if the projection electrodes are present, and a shortest distance between a projection electrode of a Y electrode and that of an X electrode paired with the Y electrode if the projection electrodes are not present, which will be described later.

The controller 200 externally receives video (image) signals, and outputs address driving control signals, X electrode driving control signals, and Y electrode driving control signals. Additionally, the controller 200 divides a single frame into a plurality of sub-fields having respective weights and drives them.

During the address period, the scan electrode driver 500 applies a selected voltage to the Y electrodes Y1 and Yn in an order of selection of the Y electrodes Y1 to Yn (i.e., sequentially), and the address electrode driver 300 receives the address driving control signals from the controller 200, and applies an address voltage for selecting discharge cells to be turned on whenever the selected voltage is applied to each of the Y electrodes, to each of the A electrodes. In other words, discharge cells formed by Y electrodes to which the selected voltage is applied and A electrodes to which the address voltage is applied when the selected voltage is applied to the Y electrodes during the address period are selected as the discharge cells to be turned on.

During the sustain period, the sustain electrode driver 400 and the scan electrode driver 500 receive control signals from the controller 200 and apply the sustain discharge pulse to the X electrodes X1 to Xn and the Y electrodes Y1 to Yn alternately.

A frequency range of the sustain discharge pulse applied for sustain discharge in the plasma display panel according to an exemplary embodiment of the present invention will now be described with reference to FIGS. 3 to 6.

Figure 3:
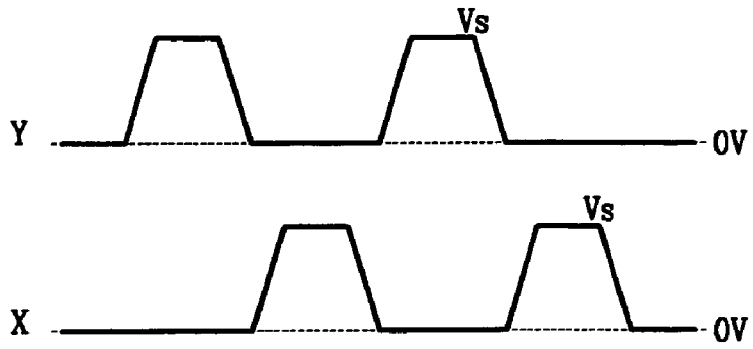
FIG. 3 is a waveform diagram illustrating sustain discharge pulses according to an embodiment of the present invention.
Figure 4:
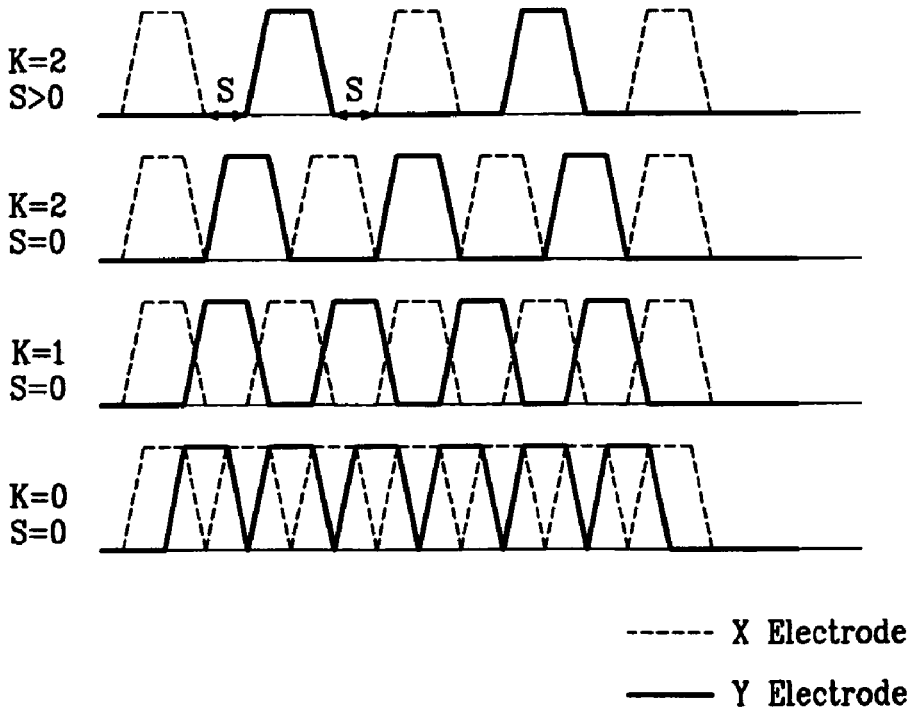
FIG. 4 shows waveform diagrams illustrating time at which a sustain discharge pulse of a scan electrode and a sustain discharge pulse of a sustain electrode are overlaid.

FIG. 3 is a diagram illustrating sustain discharge pulses according to an exemplary embodiment of the present invention, and FIG. 4 is a diagram illustrating the time at which the sustain discharge pulse of the Y electrodes and the sustain discharge pulse of the X sustain electrodes are overlaid. In the following description, the sustain discharge pulses applied to the X electrodes and the Y electrodes alternate between a voltage Vs and a ground (0V), and are out of phase opposite with each other, as shown in FIG. 3.

To begin with, a problem of the frequency of the sustain discharge pulse explained earlier in connection with Equation 1 will be described further.

The ion mobility $\mu_i$ of the Xe monomer in Equation 1 is generally determined by the following Equation 2:

$$\mu_i = \frac{1}{p}\left\{1947e^{-16.833Xe-0.011878\frac{E}{p}} + 1554.2e^{-5.1697Xe-0.00089854\frac{E}{p}} + 1158.6e^{-1.1457Xe-0.0093201\frac{E}{p}} + 131.24\right\}$$

where, Xe is a partial pressure of Xe normalized to 1 (for example, when the partial pressure of Xe is 30%, Xe is 0.3.), E is the intensity (Vs(V)/d(cm)) of an electric field generated between the X electrodes and the Y electrodes due to the sustain discharge voltage Vs, and p [Torr] is a pressure of gas in the discharge space.

In discharge cells of plasma display panels used commonly, the gap (d) between the X electrodes and the Y electrodes is 0.0075 cm, the sustain discharge voltage Vs is 220V, and the pressure (p) of gas is 450 Torr. Under this condition, if the partial pressure of Xe is 30%, the ion mobility is approximately 1.99 in Equation 2. Putting these values into Equation 1, the frequency (f) of the sustain discharge pulse over about 2.5 MHz is obtained.

However, since the Y and X electrodes act as capacitive loads when the sustain discharge pulse is applied to the Y and X electrodes, power consumption is increased as inactive power for injecting charges into the capacitive loads is consumed. Accordingly, the sustain discharge pulse is applied to the Y and X electrodes using a power recovery circuit for recovering and reusing the inactive power in the plasma display device. The power recovery circuit recovers energy to an external capacitor while discharging the capacitive loads using resonance between the capacitive loads, formed by the Y and X electrodes, and an inductor, and then charges the capacitive loads using the energy stored in the external capacitor. Such a power recovery circuit is disclosed in U.S. Pat. Nos. 4,866,349 and 5,081,400 issued to Weber et al.

In order to apply the sustain discharge pulse to the Y electrodes using the power recovery circuit, a voltage of the Y electrodes has to be increased from 0 V to the sustain discharge voltage Vs or decreased from Vs to 0 V. However, it is impossible to instantaneously change the voltage of the Y electrode. In other words, it takes a period of time (referred to as "rising time" hereinafter) to increase the voltage of the Y electrodes from 0 V to Vs using the resonance, and similarly, it takes a period of time (referred to as "falling time" hereinafter) to decrease the voltage of the Y electrodes from Vs to 0 V. In general, when the rising time of the sustain discharge pulse is increased under high partial pressure of Xe experimentally, good discharge efficiency is obtainable. The rising time is set to about 300 to 350 ns. However, when the rising time of the sustain discharge pulse is increased under low partial pressure of Xe, the discharge efficiency is poor. Accordingly, Equation 1 needs to be corrected in consideration of the rising time and the falling time of the sustain discharge pulse. Reflecting the rising time and the falling time, Equation 1 can be corrected with the following Equation 3:

$$f \geq \left\{\left(\frac{\mu_i Vs}{\pi d^2}\right)^{-1} + k(Tr + Tf) + 2s\right\}^{-1}$$

where, $\mu_i$ is the ion mobility, Vs[V] is the sustain discharge voltage, d[cm] is the gap of the X electrode and the Y electrode, Tr and Tf are the rising time and the falling time of the sustain discharge pulse, respectively, k and s are superposition coefficients of the sustain discharge pulse of the Y electrode and the sustain discharge pulse of the X electrode. In more detail, k is a period of time determined by the rising time and the falling time of a period of time when an absolute value of the voltage difference between the first electrode and the second electrode is not Vs during one cycle of the sustain discharge pulse, while s is a period of time except a period of time corresponding to the rising time and the falling time and a period of time when an absolute value of the voltage difference between the first electrode and the second electrode is Vs during one cycle of the sustain discharge pulse.

As shown in FIG. 4, s is 0 if the sustain discharge pulses of the Y and X electrodes are superimposed on each other. s denotes a period of time when voltages of the Y and X electrodes are simultaneously 0 V during one cycle of the sustain discharge pulse if the sustain discharge pulses of the Y and X electrodes are not superimposed on each other. k is a numerical value representing a degree of reflection of the rising time Tr and the falling time Tf in the sustain discharge pulses of the Y and X electrodes. When the sustain discharge pulses of the Y and X electrodes are not superimposed on each other, k is 2 since the rising time Tr and the falling time Tf are respectively reflected twice. In addition, when the sustain discharge pulses of the Y and X electrodes are superimposed on each other, k is determined depending on the degree of reflection of the rising time Tr and the falling time Tf, as shown in FIG. 4.

Herein, when the rising time Tr and the falling time Tf are set to 300 ns, k and s are 1 and 0, respectively, and the condition of the discharge cells mentioned earlier is put into Equation 3, the frequency of the sustain discharge is approximately 1 MHz. This corresponds to half the numerical value calculated in Equation 1.

Equations 1 and 3 are used for the case where the partial pressure of Xe is extremely low and Xe exists in a monomer state. However, in the case where the partial pressure of Xe is high and monomer ions ($Xe^+$) and dimer ions ($Xe_2^+$) of Xe are mixed, Equation 3 needs to be corrected.

Hereinafter, the frequency and the sustain discharge pulse will be described in consideration of the Xe dimer with reference to FIG. 5.

Figure 5:
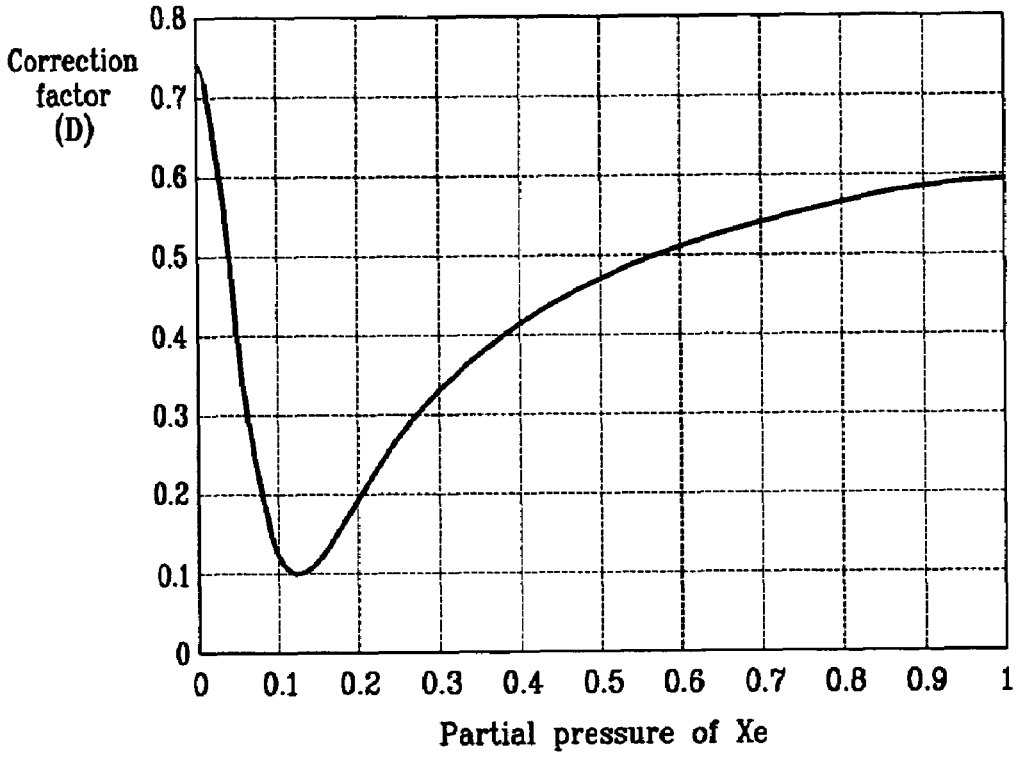
FIG. 5 is a graph showing a relationship between a partial pressure of Xe and a correction factor of ion mobility.

FIG. 5 is a graph showing the relationship between the partial pressure of Xe and a correction factor of ion mobility. In FIG. 5, the horizontal axis denotes a partial pressure of Xe normalized to 1 and the vertical axis denotes a correction factor D multiplied by mobility of the Xe monomer ions to obtain actual ion mobility. As shown in FIG. 5, while the Xe dimer is formed as the partial pressure of Xe is increased to about 10%, the ion mobility is rapidly decreased by the interaction between the Xe monomer ions ($Xe^+$) and the Xe dimer ions ($Xe_2^+$).

Subsequently, when the partial pressure of Xe is further increased to about 20%, Xe mostly exists in a dimer state and hence the interaction between the Xe monomer ions and the Xe dimer ions is decreased. Accordingly, the ion mobility is again increased to reach the ion mobility of substantially between 50 and 60% of the ion mobility in the dimer state.

Thus, the relationship is between the partial pressure of Xe and the correction factor (D) is expressed by the following Equation 4:

$$D = -\frac{1 - e^{-110Xe^{1.9}}}{6(Xe + 0.1)} + 0.74$$

where, D is a factor resulting from a division of the actual ion mobility of Xe by the ion mobility of Xe in the monomer state, and Xe is the partial pressure of Xe normalized to 1.

Reflecting this correction factor D, Equation 3 is changed to the following Equation 5:

$$f \geq \left\{\left(\frac{D\mu_i Vs}{\pi d^2}\right)^{-1} + k(Tr + Tf) + 2s\right\}^{-1}$$

Figure 6:
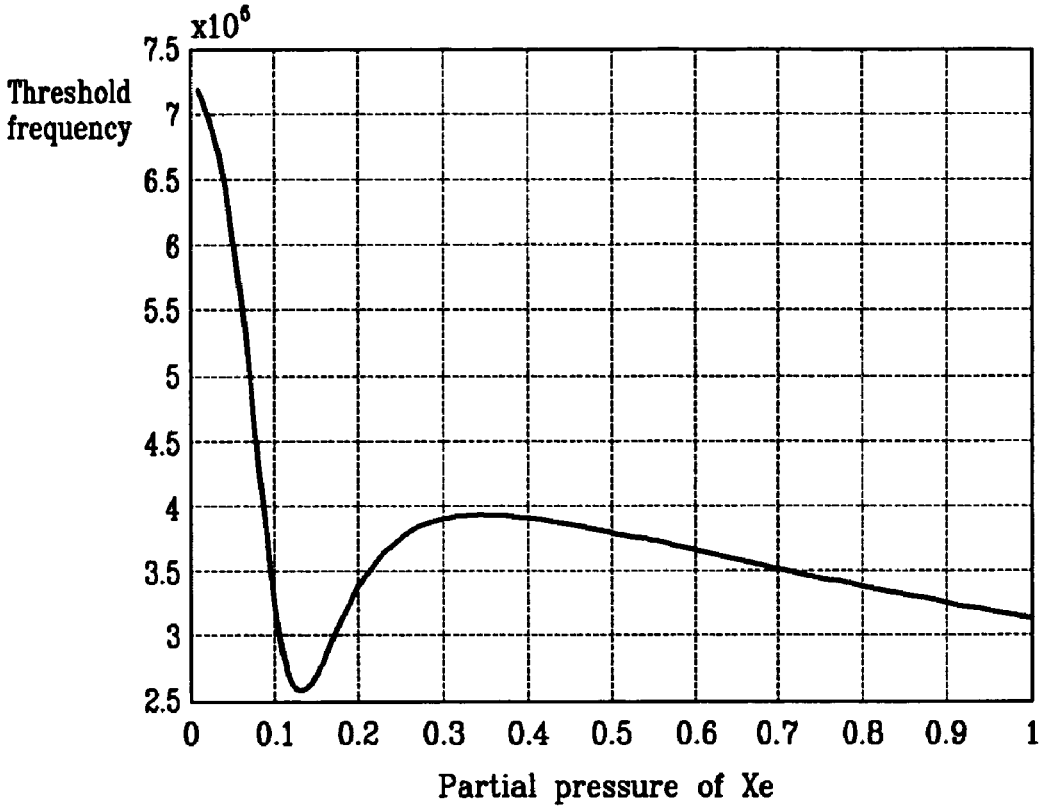
FIG. 6 is a graph showing a relationship between a partial pressure of Xe and a threshold frequency of a sustain discharge pulse.

Under the condition of the discharge cells (d=0.0075 cm, Vs=220 V, and p=450 Torr) and the condition of the sustain discharge pulse (Tr=300 ns, k=1, and s=0) mentioned above, the minimum value (threshold frequency) of the frequency f determined in Equation 5 depending on the partial pressure of Xe is as shown in FIG. 6. Referring to FIG. 6, the threshold frequency at which the discharge efficiency is expected to improve as the partial pressure of Xe is increased above 10% is determined within a range of about 300 kHz to 550 kHz. Namely, when the frequency of the sustain discharge pulse is set above the threshold frequency of 300 kHz, the discharge efficiency is expected to improve.

As described above, in accordance with the first exemplary embodiment of the present invention, the discharge efficiency can be improved when the frequency of the sustain discharge pulse is set in the frequency range determined by Equation 5. Particularly, the discharge efficiency can be improved by setting the frequency of the sustain discharge pulse above 300 kHz under conditions of general plasma display panels.

In the first exemplary embodiment of the present invention, the lowest limit threshold frequency of the sustain discharge pulse for improving the discharge efficiency has been described. Hereinafter, the upper limit frequency of the sustain discharge pulse will be described with reference to FIG. 7.

Figure 7:
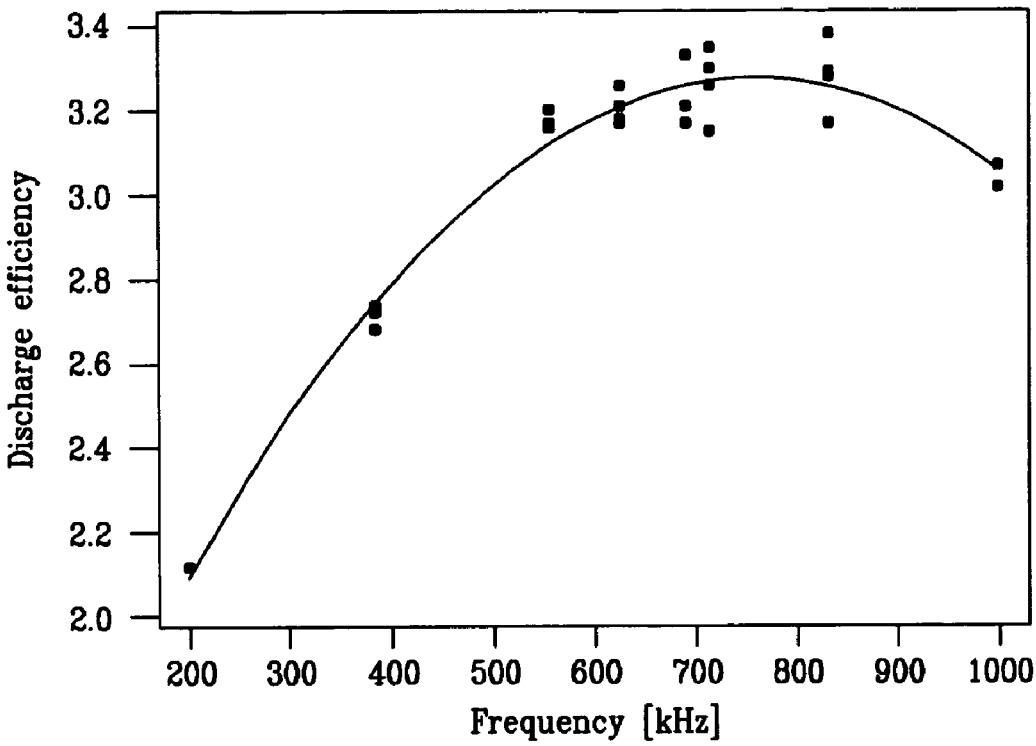
FIG. 7 is a graph showing a relationship between a frequency of a sustain discharge pulse and a discharge efficiency under a condition that the threshold frequency is 500 kHz.

FIG. 7 is a graph showing a relationship between the frequency of the sustain discharge pulse and the discharge efficiency under the condition that the threshold frequency is determined as 500 kHz in Equation 5.

Referring to FIG. 7, it can be seen that the discharge efficiency is increased as the frequency of the sustain discharge pulse is increased, particularly, the discharge efficiency is about 3.0 when the frequency of the sustain discharge pulse is the threshold frequency of 500 kHz. On the other hand, it can be seen that the discharge efficiency is decreased when the frequency of the sustain discharge pulse is above 750 kHz, particularly, the discharge efficiency is lower than the discharge efficiency set to the threshold frequency of 500 kHz when the frequency of the sustain discharge pulse is above 1 MHz. In other words, when the frequency of the sustain discharge pulse is about 1 MHz, the discharge efficiency is saturated. This has some connection with the power recovery ratio of a power recovery circuit.

The power recovery circuit is used when the sustain discharge pulse is applied to the X electrode and the Y electrode, as described earlier. In this case, the power recovery ratio of the power recovery circuit may be decreased when the frequency of the sustain discharge pulse is increased. When the frequency of the sustain discharge pulse is increased, it is necessary to shorten the rising time and the falling time of the sustain discharge pulse. The rising time and the falling time are determined by a capacitive component and an inductive component, which form a resonant circuit. Herein, the capacitive component is a value determined by properties of the plasma display panel. Therefore, the rising time and the falling time are adjustable by adjusting the size of an inductor used in the power recovery circuit. Namely, the size of the inductor is small so as to shorten the rising time and the falling time of the sustain discharge pulse.

In general, flexible printed circuits (FPCs), patterns and the like, used when the X electrode and Y electrode drivers are coupled to the X electrode and the Y electrode, respectively, become lengthened as the plasma display panel becomes large in size. In this case, a parasite inductive component is increased between the X and Y electrodes and the drivers thereof. When the resonance is generated as the size of the inductor becomes small, the power recovery ratio has to be decreased as the influence of the parasite inductive component becomes large. In addition, when the frequency of the sustain discharge pulse becomes higher, a large displacement current instantaneously flows through the capacitive component formed by the Y and X electrodes, which imposes a heavy burden on the power recovery circuit. Therefore, the frequency of the sustain discharge pulse cannot be set too high. The threshold frequency is set to about 1 MHz in typical power recovery circuits.

Figure 8:
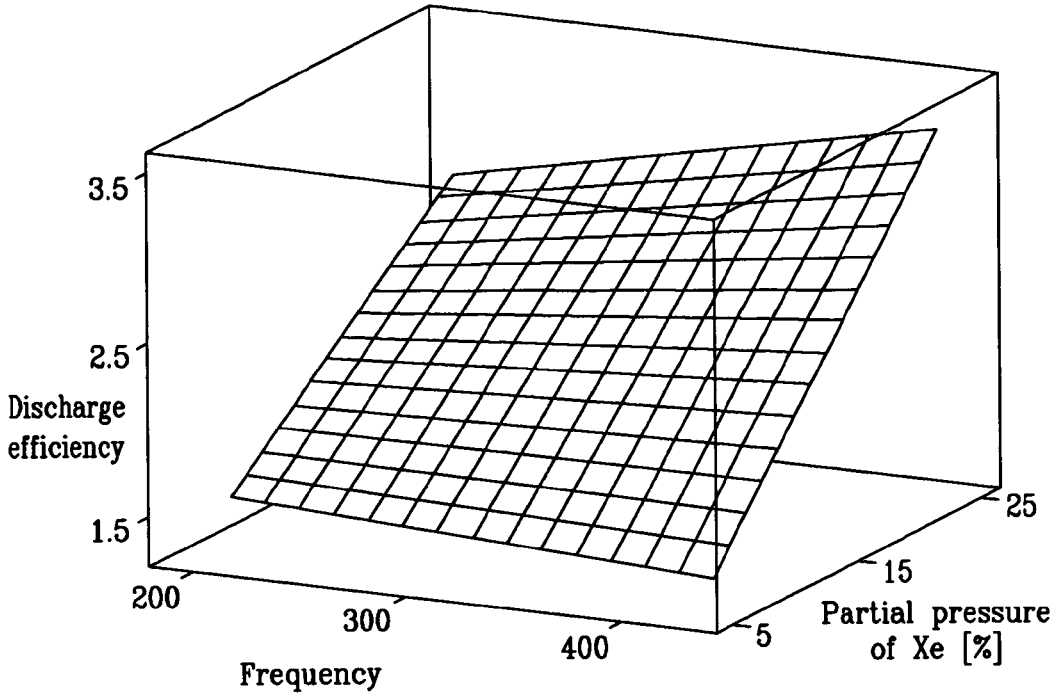
FIG. 8 is a three-dimensional graph showing a discharge efficiency measured while varying the frequency of the sustain discharge pulse and the partial pressure of Xe.

Next, a range of the partial pressure of Xe where it is expected to improve the discharge efficiency when the frequency of the sustain discharge pulse is increased will be described with reference to FIG. 8 which shows the discharge efficiency measured while varying the frequency of the sustain discharge pulse and the partial pressure of Xe. The measured discharge efficiency Eff. in FIG. 8 is approximated by the following Equation 6:

$$Eff. = 1.42120 - 0.00183633 \times f + 0.0317506 \times Xe + 0.000177615 \times f \times Xe$$

When Equation 6 is differentiated with regard to the frequency f of the sustain discharge pulse, it is changed to Equation 7:

$$-0.00183633 + 0.000177615 \times Xe = 0$$

Accordingly, as is seen from Equation 6, the partial pressure of Xe is set to 10% as a critical point at which the discharge efficiency is increased as the frequency is increased.

As described above, in accordance with the exemplary embodiment of the present invention, when the partial pressure of Xe is high, the discharge efficiency can be improved by setting the frequency of the sustain discharge pulse above the threshold frequency determined by Equation 5. In this embodiment, the frequency of the sustain discharge pulse is set to about 300 kHz. In addition, the frequency of the sustain discharge pulse can be set below the threshold frequency of about 2.5 MHz determined in Equation 1 at which the sustain discharge pulse has to be used in the form of a sinusoidal wave in the conventional technique. Also, in this embodiment, the frequency of the sustain discharge pulse can be set below 1 MHz in consideration of the operational burden and power recovery ratio of the power recovery circuit. In addition, in this embodiment, it is expected that the discharge efficiency is improved in a range where the partial pressure of Xe is above about 10% experimentally.

In addition, when the frequency of the sustain discharge pulse is high as in this embodiment, luminance of an image signal is decreased. This can overcome a problem wherein expression of a low level of gray scale is deteriorated as the discharge efficiency is increased. In addition, when the frequency of the sustain discharge pulse is high, the sustain period can be reduced. Time saved by the reduction of the sustain period can be allocated for expression of gray scale or reduction of pseudo contour.

In the embodiments described above, the sustain discharge pulse is assumed to have the waveform shown in FIG. 3. However, without limiting exemplary embodiments of the present invention to such a sustain discharge pulse, other sustain discharge pulses having other waveforms are applicable.

Figure 9:
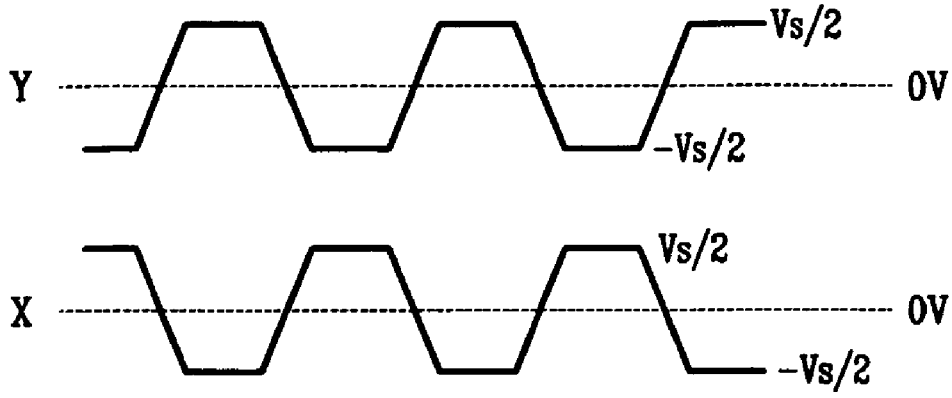
FIGS. 9 and 10 are waveform diagrams illustrating sustain discharge pulses according to another embodiment of the present invention.
Figure 10:
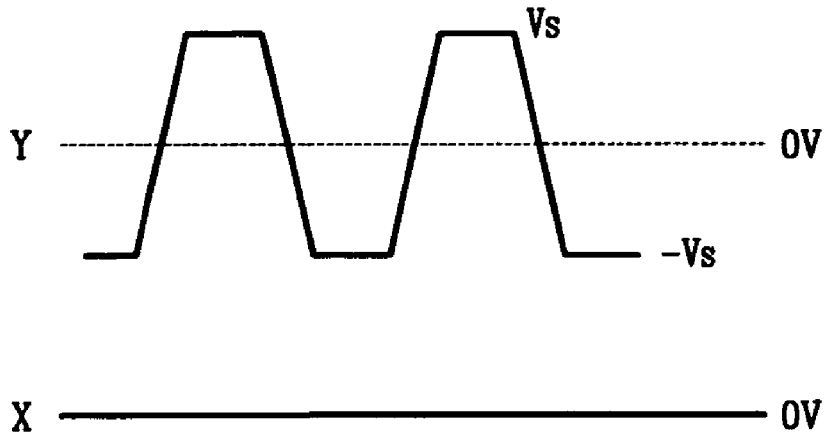

FIGS. 9 and 10 are diagrams illustrating sustain discharge pulses according to other embodiments of the present invention.

Referring to FIG. 9, the sustain discharge pulse applied to the X and Y electrodes alternates between a voltage of Vs/2 and a voltage of −Vs/2 which have opposite phases. Thus, a voltage difference between the Y and X electrodes alternates between Vs and −Vs. In FIG. 9, k in Equation 5 is always 1 and s is determined by a period of time during which the voltage difference is the ground (0V) in one cycle of the sustain discharge pulse.

Referring to FIG. 10, the sustain discharge pulse having the alternating voltage Vs and the voltage −Vs is applied to the Y electrode in a state where the X electrode is biased to the ground. Thus, a voltage difference between the Y and X electrodes alternates between Vs and −Vs. In FIG. 10, k in Equation 5 is always 1 and s is determined by a period of time during which the voltage difference is the ground (0V) in one cycle of the sustain discharge pulse.

In the embodiments described above, the plasma display panel has three electrodes including the A electrode, the Y electrode and the X electrode. However, without being limited to three electrodes, the present invention is applicable to other plasma display panels having other forms of electrodes which are capable of creating the sustain discharge using the applied sustain discharge pulse mentioned above.

As is apparent from the above description, in accordance with the present invention, by setting the frequency of the sustain discharge pulse according to the increase of the partial pressure of Xe, the discharge efficiency of the plasma display panel can be improved.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display device comprising:

a plasma display panel including discharge cells having at least two electrodes including a first electrode and a second electrode; and a driver for applying a sustain discharge pulse to at least one of the first electrode and the second electrode during a sustain period such that a voltage difference between the first electrode and the second electrode alternates between a positive voltage and a negative voltage, wherein the sustain discharge pulse has a frequency f defined by:

$$\frac{\mu_i Vs}{\pi d^2} > f \geq \left\{\left(\frac{D\mu_i Vs}{\pi d^2}\right)^{-1} + k(Tr + Tf) + 2s\right\}^{-1}$$

where:

$D\mu_i$ is mobility of Xe ions of the discharge gases injected into the discharge spaces of the discharge cells, Vs is the absolute value of the positive voltage or the negative voltage, d is a gap distance between the first electrode and the second electrode, Tr and Tf are rising time and falling time of the sustain discharge pulse, respectively, k is a period of time during one cycle of the sustain discharge pulse determined by the rising time and the falling time of a period of time when an absolute value of the voltage difference between the first electrode and the second electrode is not Vs, and s is a period of time during one cycle of the sustain discharge pulse other than a period of time corresponding to the rising time and the falling time and a period of time when an absolute value of the voltage difference between the first electrode and the second electrode is Vs.

2. The plasma display device of claim 1, wherein $\mu_i$ is defined by:

$$\mu_i = \frac{1}{p}\left\{1947e^{-16.833Xe-0.011878\frac{E}{p}} + 1554.2e^{-5.1697Xe-0.00089854\frac{E}{p}} + 1158.6e^{-1.1457Xe-0.0093201\frac{E}{p}} + 131.24\right\}$$

where, E is Vs/d, p(Torr) is a gas pressure of the discharge cells, Xe is a partial pressure of Xe normalized to 1, D is a factor resulting from a division of the actual ion mobility of Xe by the ion mobility of Xe in the monomer state.

3. The plasma display device of claim 2, wherein D is defined by:

$$D = -\frac{1 - e^{-110Xe^{1.9}}}{6(Xe + 0.1)} + 0.74.$$

4. The plasma display device of claim 1, wherein a partial pressure of Xe is above 10%.

5. The plasma display device of claim 1, wherein, during the sustain period, the driver applies the sustain discharge pulse having a first voltage and a second voltage alternately to the first electrode and applies the sustain discharge pulse having the first voltage and the second voltage alternately to the first electrode and having a phase opposite to a phase of the sustain discharge pulse applied to the first electrode.

6. The plasma display device of claim 1, wherein, during the sustain period, the driver applies the sustain discharge pulse having the second voltage and a fourth voltage alternately to the second electrode in a state where the first electrode is biased to the first voltage, the second voltage being higher than the first voltage and the third voltage being lower than the first voltage.

7. The plasma display device of claim 1, wherein the first electrode and the second electrode extend plurally in one direction in the plasma display panel, the plasma display panel further comprises a plurality of third electrodes extending across the first and second electrodes, and wherein the discharge cells have the plurality of first electrodes, the plurality of second electrodes and the plurality of third electrodes.

* * * * *